US007083466B1

(12) United States Patent
Hwang

(10) Patent No.: US 7,083,466 B1
(45) Date of Patent: Aug. 1, 2006

(54) COVER OF WIRING BOX FOR USE IN TELECOMMUNICATION LINE

(76) Inventor: Wayming Hwang, No. 69, Feng-Chia Road, Pingtung City (TW)

( * ) Notice: Subject to any disclaimer, the term of this patent is extended or adjusted under 35 U.S.C. 154(b) by 0 days.

(21) Appl. No.: 11/123,025

(22) Filed: May 6, 2005

(51) Int. Cl.
*H01R 13/60* (2006.01)

(52) U.S. Cl. ..... 439/536
(58) Field of Classification Search ..... 439/536; 174/66, 67
See application file for complete search history.

(56) References Cited

U.S. PATENT DOCUMENTS 5,458,503 A * 10/1995 Below ..... 439/404

* cited by examiner

*Primary Examiner*—Ross Gushi
(74) *Attorney, Agent, or Firm*—Rosenberg, Klein & Lee

(57) ABSTRACT

A cover of a wiring box for use in a telecommunication line is disclosed. At least two connection ports are formed on the cover for wiring various telecommunication lines such as indoor and outdoor telecommunication cables with various sources. If the extension line is poor or the telephone exchange line is failed some day, the maintenance worker just needs to perform the repair process on the connection ports directly. There is no need to detach the cover. Accordingly, the multiple functions of facilitating the repair process and reducing the required repair time are achieved.

3 Claims, 3 Drawing Sheets

COVER OF WIRING BOX FOR USE IN TELECOMMUNICATION LINE

FIELD OF THE INVENTION

The present invention relates to a device for wiring indoor telecommunication line, and more particularly to a cover of a wiring box for use in a telecommunication line.

BACKGROUND OF THE INVENTION

In the modern building, wiring holes (not shown) are reserved on the walls of every house for wiring telecommunication lines. As shown in FIG. 1, a wiring box 1 is mounted in a wiring hole. In addition to be wired to an outdoor telecommunication cable for the purpose of external communication, the wiring box 1, which is mounted everywhere in the indoor space, is also wired to an indoor telecommunication cable so as to interlink the indoor extensions. However, in practice, the existing wiring box 1 is only capable of being wired to one or two telecommunication line(s). It provides with no function related to the extension line and cannot be wired to multiple telecommunication lines. Furthermore, the connection between the telecommunication lines and every core wire are insulated by tape. It results in inconvenience since the cover 11 is closed. Accordingly, when the telecommunication line is failed, the maintenance worker must detach the whole cover 11 of the wiring box 1 first, and then pull out the telecommunication cable for peeling off the tape, which winds the outside of the telecommunication cable, before repairing the telecommunication line. Consequently, the entire repair process is very complicated and time-consuming.

SUMMARY OF THE INVENTION

In view of the aforementioned deficiencies caused by the conventional structure, the present inventor provides a cover of a wiring box for use in a telecommunication line with the multiple functions of facilitating the repair process and reducing the required repair time.

In order to cure the aforementioned deficiencies, a cover of a wiring box for use in a telecommunication line is provided. At least two connection ports are formed on the cover for wiring various telecommunication lines such as indoor and outdoor telecommunication cables. If the extension line is poor or the telephone exchange line is failed some day, the maintenance worker just needs to perform the repair process on the connection ports directly. There is no need to detach the cover. Accordingly, the multiple functions of facilitating the repair process and reducing the required repair time are achieved.

DETAILED DESCRIPTION OF THE PREFERRED EMBODIMENT

The description taken with the drawings make the structures, features, and embodiments of the present invention apparent to those skilled in the art how the present invention may be embodied in practice.

Figure 1:
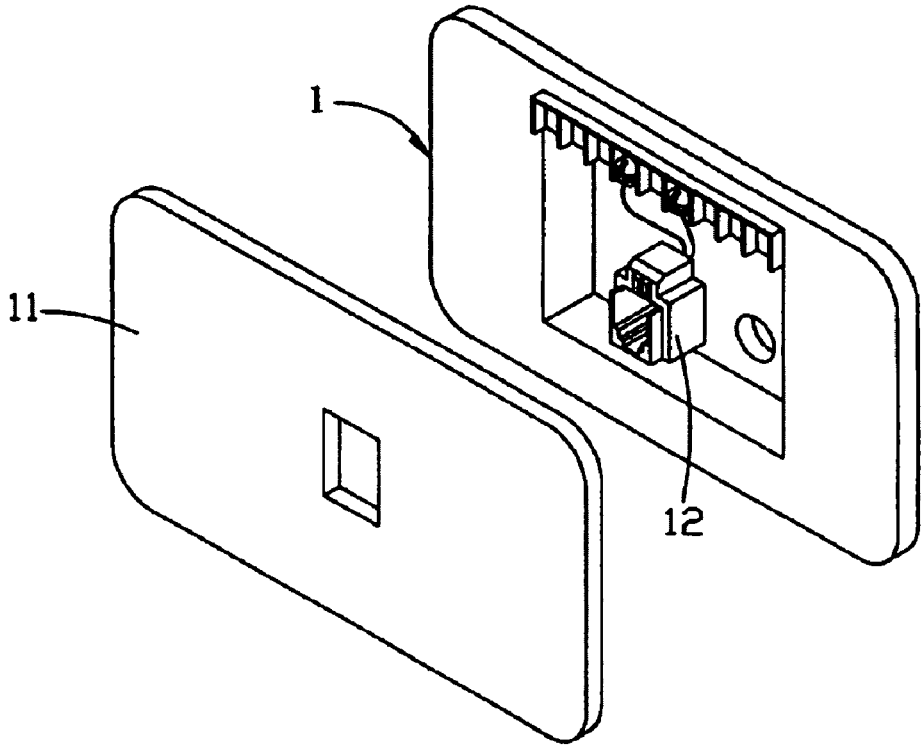
PRIOR ART Fig. 1
FIG. 1 is an elevational decomposed view showing a conventional wiring box mounted on the wall.
Figure 2:
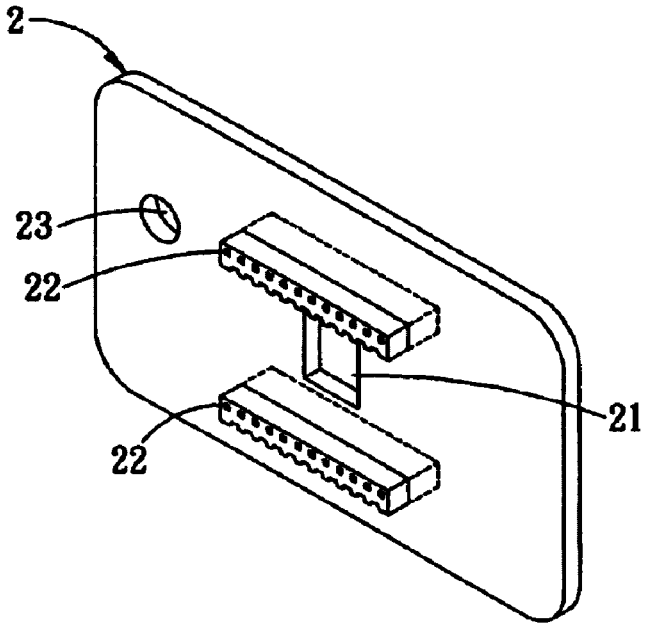
FIG. 2 is an elevational decomposed view of the present invention.

Referring to FIG. 2, the present invention pertains to a cover of a wiring box for use in a telecommunication line. A socket hole 21 is formed on the main body of the cover 2. At least two connection ports 22 and at least a through hole 23 are formed on the surface of the cover 2 near the socket hole 21.

Figure 3:
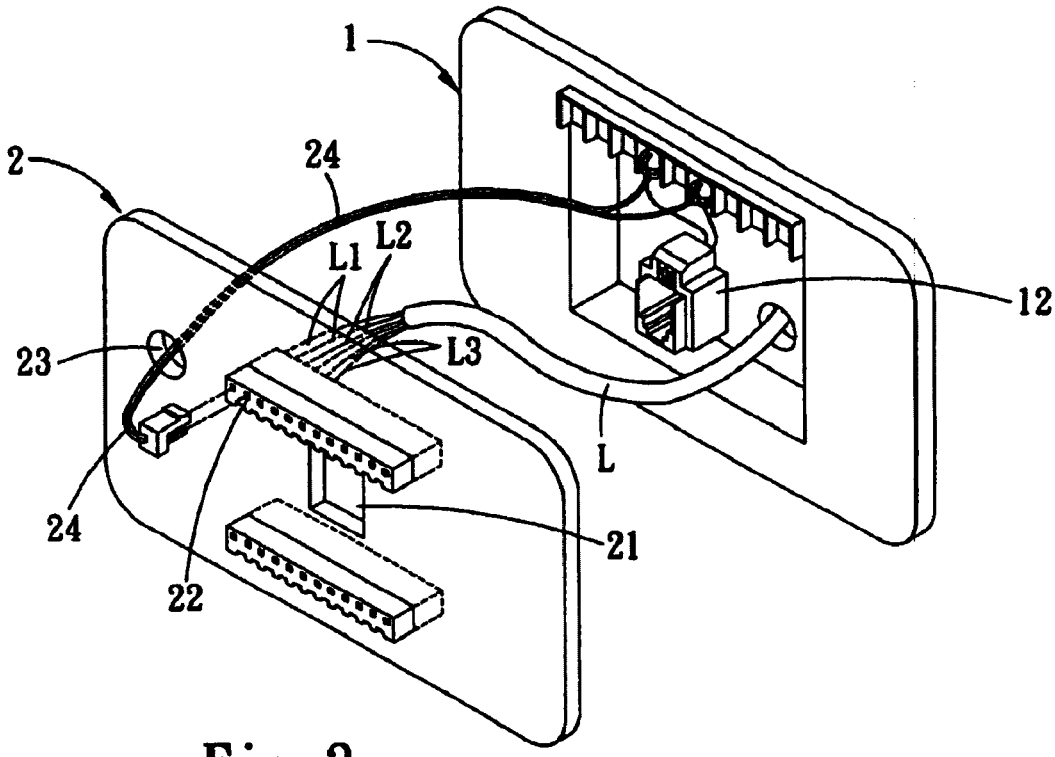
FIG. 3 is an elevational schematic view showing that the structure of the present invention is wired to the outdoor telecommunication cable.

FIG. 3 shows that the structure of the present invention is wired to an outdoor telecommunication cable L. Referring to FIG. 3, one of the connection ports 22 is further connected to at least a telecommunication conducting wire 24. The telecommunication conducting wire 24 is a dual-core wire. The telecommunication conducting wire 24 is connected to the connection port 22 on one side of the cover 2 by piercing its one end through the through hole 23, and it is further electrically connected to a signal wire (not shown), which is plugged into a RJ11 socket 12 of a wiring box 1 on the wall. When the present invention is put into practice, there is merely a need to electrically connect a telephone exchange wire L1 of the outdoor telecommunication cable L and the connection port 22 in the direction from the other side of the cover 2. Accordingly, the telecommunication signal, which is transmitted through the telephone exchange wire L1, is capable of being transmitted to the RJ11 socket 12 of the wiring box 1 through the connection port 22 and the telecommunication conducting wire 24 to complete the wiring process for a single telephone exchange. Furthermore, when the outdoor telecommunication cable L is further provided with other telephone exchange wires L2, L3, etc., these wires can be wired according to the above-mentioned description, which is omitted herein.

Figure 4:
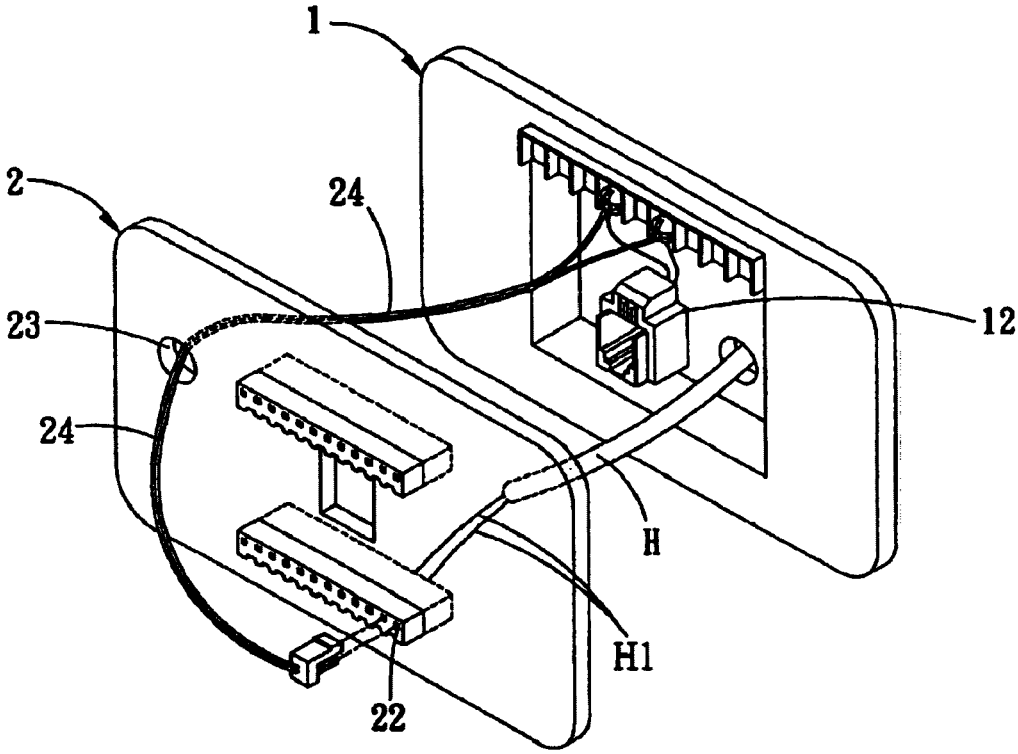
FIG. 4 is an elevational schematic view showing that the structure of the present invention is wired to the indoor telecommunication cable.

FIG. 4 shows that the structure of the present invention is wired to an indoor telecommunication cable H. Referring to FIG. 4, an extension wire H1 of the indoor telecommunication cable H is electrically connected to the other of the connection ports 22 such that the extension signal transmitted through the extension wire H1 is capable of being transmitted to the RJ11 socket 12 of the wiring box 1 through the connection port 22 and the telecommunication conducting wire 24 to complete the wiring process for extension line.

Figure 5:
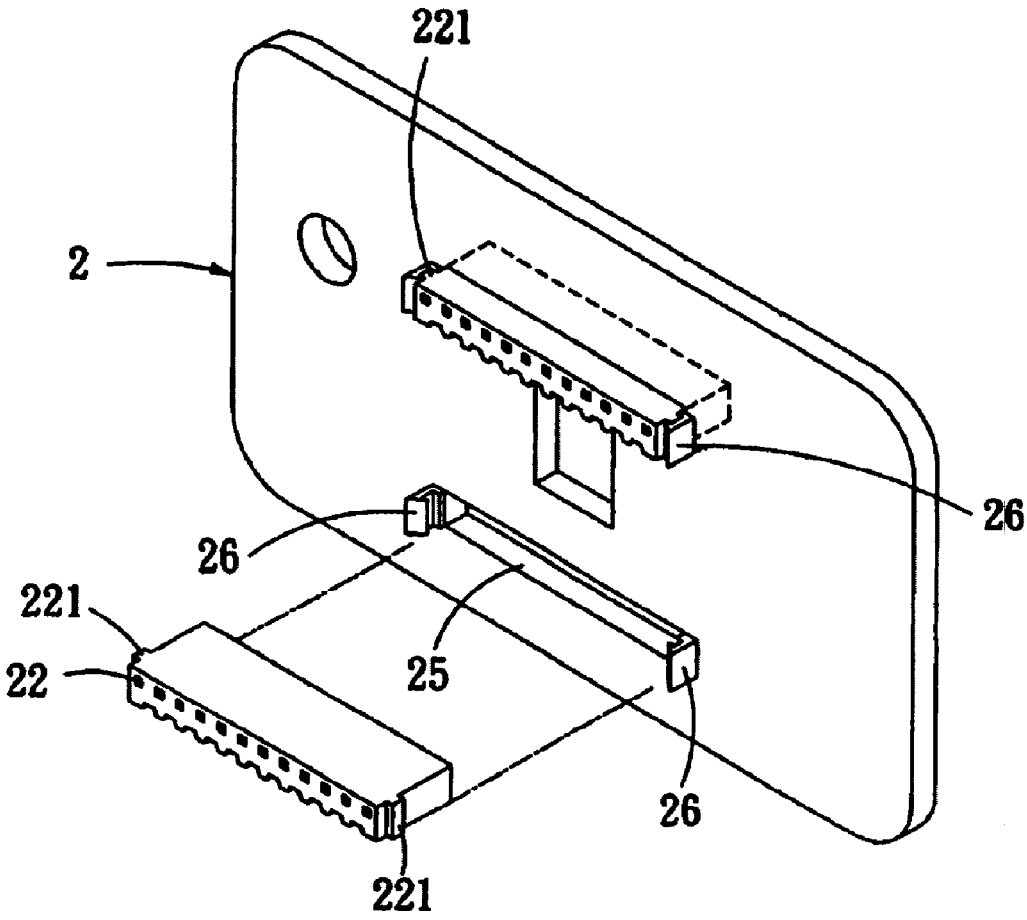
FIG. 5 is an exploded view showing a cover of another preferred embodiment of the present invention.

Referring to FIG. 5, a cover 2 of another preferred embodiment of present invention is shown. At least an opening 25 is formed on the surface of the cover 2 for holding the connection port 22, and at least two buckling parts 26 are oppositely mounted on the surface of the cover 2 near the opening 25. Besides, a detent 221 is mounted on the connection port 22 corresponding to the outer edge of each buckling part 26 of the cover 2 for securing the connection port 22 to the buckling parts 26 of the cover 2. When the line is poor or failed, there is no need to detach the cover by detaching the connection port 22 directly for performing the repair process.

The present invention provides the following efficacy and advantage, in which:

1. After being wired to the outdoor and indoor telecommunication cables, the RJ11 socket of the wiring box of the present invention is provided with the function of communication for multi-machine and extensions.

2. When the telephone exchange line is failed and needs to be repaired, there is no need for the maintenance worker to detach the cover by performing the repair process on the connection ports directly. Accordingly, it is very convenient.

3. When the extension line occurs the phenomenon of poor signal, the maintenance worker can use another connection port for jumping wire directly. Accordingly, the repair process can be simplified efficiently and the required repair time is significantly reduced.

On the basis of the description mentioned above, the present invention indeed satisfies requirements for patentability, and is therefore submitted for a patent.

With the invention thus explained, it is apparent that various modifications and variations can be made without departing from the scope of the invention. It is therefore intended that the invention be limited only as indicated in the appended claims.

What the invention claimed is:

1. A cover of a wiring box for use in a telecommunication line, wherein a socket hole is formed on the cover, the cover comprising:

at least two connection ports formed on a surface of the cover near the socket hole for wiring the telecommunication line, wherein the cover has at least one opening formed on the surface of the cover for holding each of said at least two connection ports;

at least two buckling parts oppositely mounted on the surface of the cover near said at least one opening; and a detent mounted on the connection ports corresponding to an outer edge of each buckling part of the cover for securing the connection ports to the buckling parts of the cover.

2. The cover of claim 1, wherein the cover further has at least one through hole formed thereon.

3. The cover of claim 2, wherein at least one telecommunication conducting wire is electrically connected by one end thereof to a respective one of said at least two connection ports.

* * * * *